United States Patent [19]

Grendahl

[11] 4,001,959

[45] Jan. 11, 1977

[54] ROTARY PICTURE FRAME

[76] Inventor: Russell S. Grendahl, P.O. Box 115, Pennock, Minn. 56279

[22] Filed: July 23, 1975

[21] Appl. No.: 598,531

[52] U.S. Cl. ..... 40/152.1; 47/39; 40/68

[51] Int. Cl.[2] ..... G09F 1/12

[58] Field of Search ..... 47/39; 40/152.1, 68, 40/77.8, 152, 152.2, 33

[56] References Cited

UNITED STATES PATENTS

| | | | |
|---|---|---|---|
| 280,556 | 7/1883 | Bassett et al. | 40/77.8 |
| 495,016 | 4/1893 | Burke | 40/152.2 X |
| 495,808 | 4/1893 | Holt et al. | 40/152 X |
| 3,345,766 | 10/1967 | Timlin | 40/64 R X |

*Primary Examiner*—Louis G. Mancene
*Assistant Examiner*—Wenceslao J. Contreras
*Attorney, Agent, or Firm*—Merchant, Gould, Smith, Edell Welter & Schmidt

[57] ABSTRACT

New and improved interior decorating apparatus comprising a three-dimensional picture frame. Means are provided for displaying a plurality of pictures around the periphery of a polyhedral or semipolyhedral body in a plurality of openings defined by a top, a bottom, and spacers extending therebetween and grooved to support, display, and protect the pictures. Arrangements are shown for supporting the apparatus rotatably from below, suspending it from above, or securing it to a wall. The apparatus is specially apertured so that a potted plant may be used in connection with the pictures. Other decorative arrangements using the apparatus are suggested.

8 Claims, 7 Drawing Figures

ROTARY PICTURE FRAME

BACKGROUND OF THE INVENTION

This invention relates to the general field of interior decorating, and particularly to a new and improved picture frame in which several pictures may be simultaneously displayed in an artistic arrangement adapted for use as a versatile decorative accent alone or in combination with other elements such, for example, as plants, flowers or figurines.

Pictures are used widely in interior decoration both as accents and as foci of interest. They are traditionally displayed in frames, and frequently several related pictures are suitably displayed in a single frame, where they are all arranged in a single plane. It is also known to mount a pair of pictures in a combination frame resembling an open book, or to use plural pictures in separate easels on a common surface as a decorative unity, often reinforced or accented by plants, figurines, and similar items.

SUMMARY OF THE INVENTION

The present invention comprises a more sophisticated frame in which a plurality of pictures are displayed for simultaneous viewing from several directions. Herein the word "picture" is intended to include photographs, originals or reproductions of works of two-dimensional art, and displays of printed material. In one embodiment, the assembly may be rotated to bring every picture into a given line of sight. The frame may be supported from above or below, and it may be ued in combination with other elements such as plants or figurines. In another embodiment, it may be mounted against a wall or other vertical surface for viewing in a range of 180°.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 1:
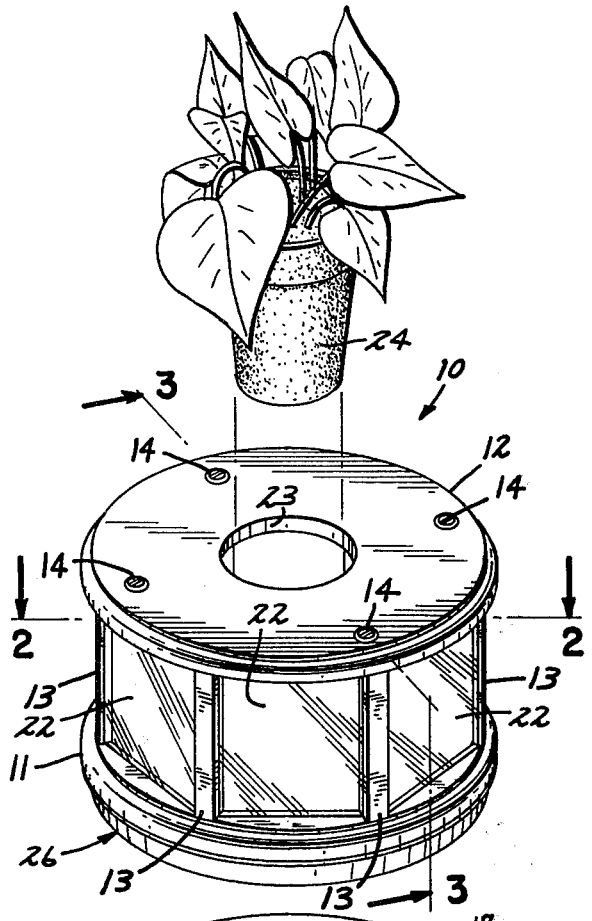
FIG. 1 is a perspective view of one embodiment of the invention.
Figure 2:
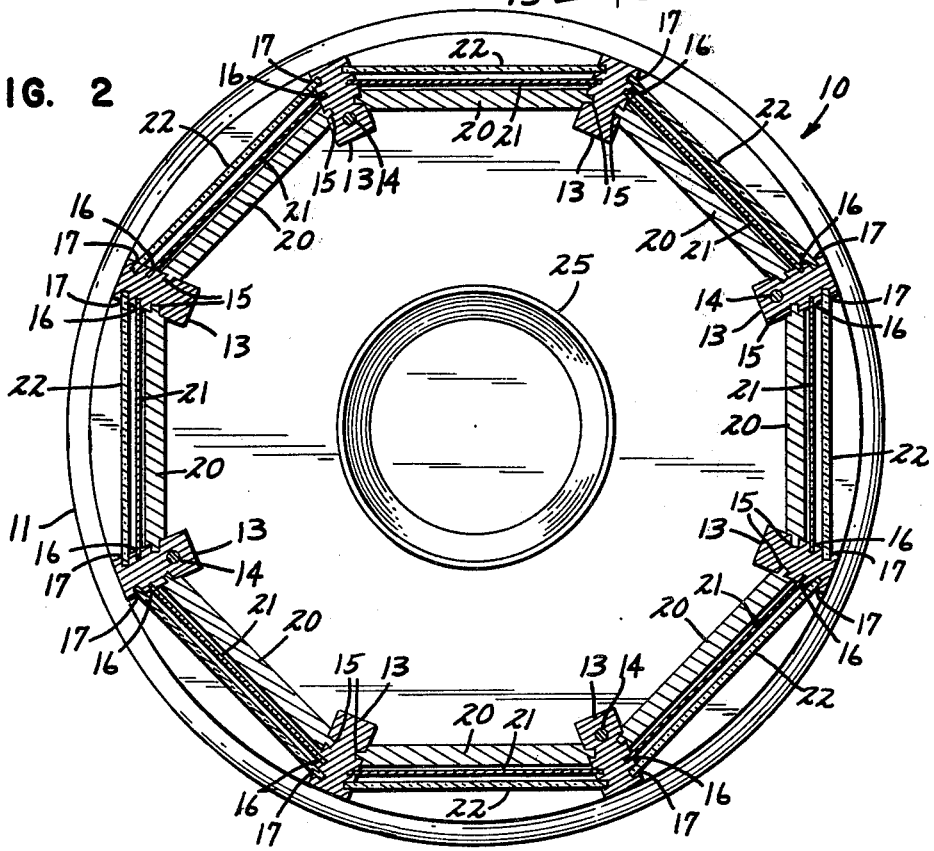
FIG. 2 is an enlarged horizontal section of this embodiment of the invention taken along the line 2—2 of FIG. 1.
Figure 3:
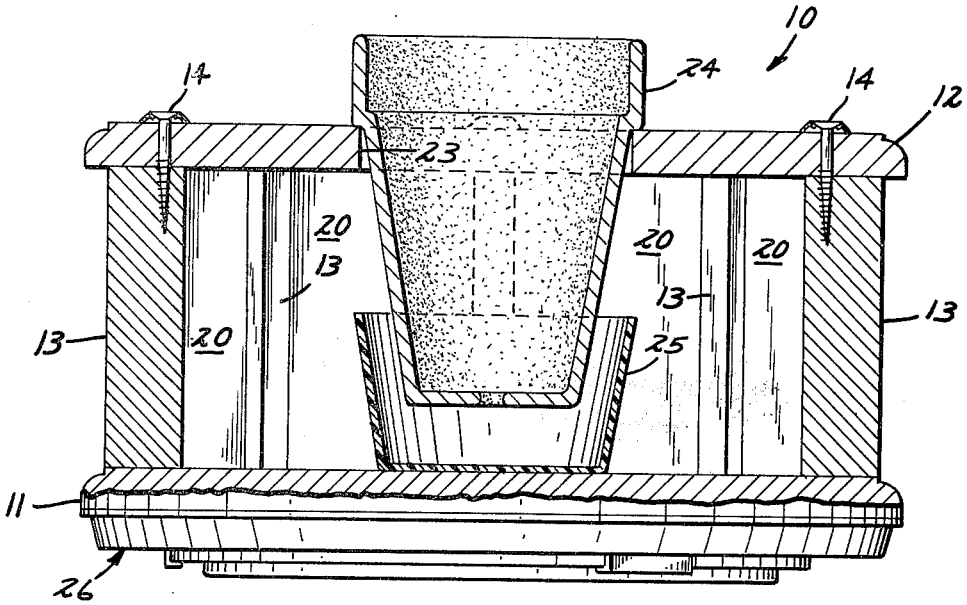
FIG. 3 is a sectional view along the line 3—3 of FIG. 1 to a larger scale.
Figure 4:
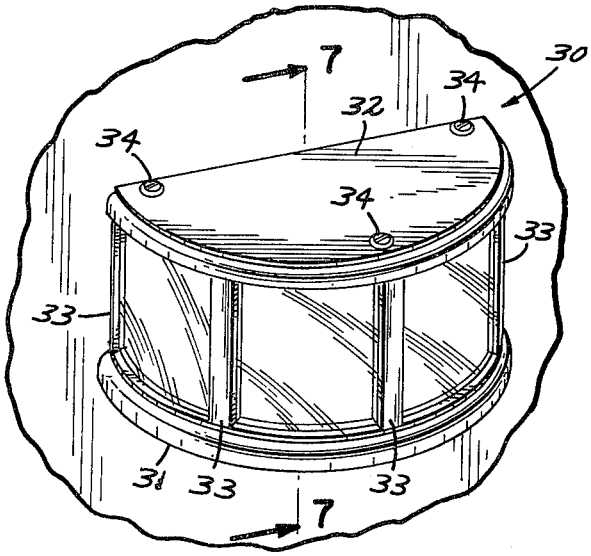
FIG. 4 is a perspective view of a further embodiment of the invention.
Figure 5:
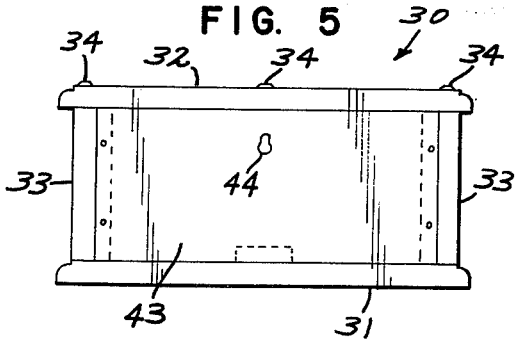
FIG. 5 is a back view of the structure of FIG. 4.
Figure 6:
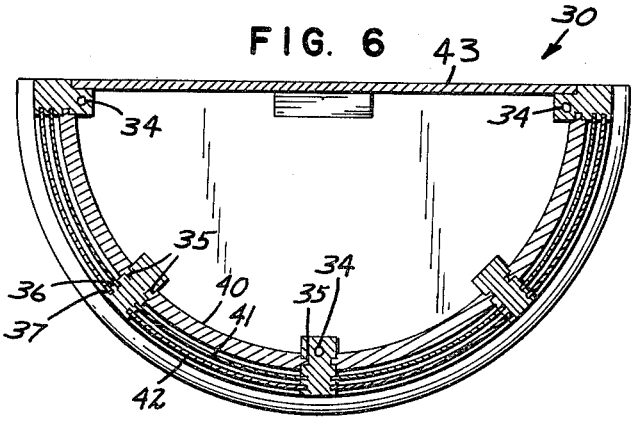
FIG. 6 is a view like FIG. 2 of the second embodiment.
Figure 7:
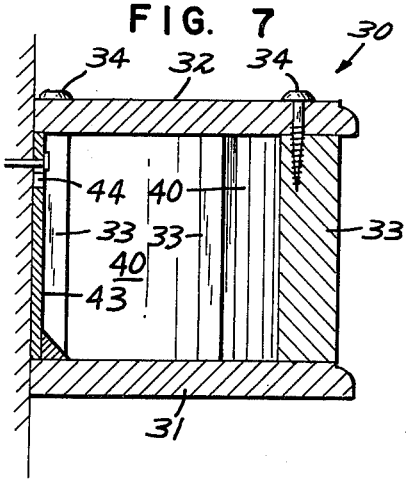
FIG. 7 is a sectional view taken along the line 7—7 of FIG. 4.

A preferred embodiment 10 of my invention is shown in FIGS. 1–3 as a three-dimensional body comprising a base 11, a top 12, and a plurality of spacers 13. Base 11 and top 12 have a predetermined outline, in this figure a circle, and are shown as of equal size. Spacers 13 are located equidistantly around the base to which they are fastened, and extend from it vertically toward top 12, which is attached thereto by means such as screws 14. The base, top, and spacers combine to define a plurality of openings, 8 as shown in the figure. The sides of each opening are the apposed edges of a pair of spacers.

The spacers are provided with grooves for receiving a picture, means for protecting the picture such as a sheet of glass or plastic, and means for supporting the picture. The grooves are so oriented in the spaces that they lie in a predetermined geometric surface. While they are shown as lying in planes, for simplicity, it will be realized that the frame can equally well be designed for openings defined by circular or other cylinders, either convex or concave, or by obtuse or acute dihedral angles. If the top is smaller than the bottom, the surface may be pyramidal, or circular or other conical surfaces may be used. Any surface may be used into which a flat picture can be rolled or folded, and the more complex surfaces may be combined with plane surfaces when special effects are desired.

For versatility, each edge of each spacer is shown to have an inner groove 15, an intermediate groove 16, and an outer groove 17. Inner grooves 15 receive picture supporting means 20 which are shown as wooden members having tongues at their ends to be received in the grooves. Members 20 may be glued into grooves 15 to increase the strength and rigidity of the assembly. Alternatively, members 20 may be transparent, so that a light source within the body may illuminate the pictures in the form of transparencies, or so that the interior of the body may be used as a sort of grotto for uniquely displaying some art objects illuminated from within or through one or more others of the openings. Members 20 are shown as flat, but they may also be convex or concave on their outer surfaces to accord with the decorative intent.

Intermediate grooves 16 are intended to receive the pictures 21 to be displayed, and grooves 17 contain picture protecting members 22, such as pieces of glass or plastic. Where the decorative intent has dictated non-planar surfaces, protection members 22 are given the same non-planar configuration as members 20, so that each picture 21 is retained in its curved or other configuration by being held between a member 20 and a member 22.

As shown in the drawings, top 12 may have a large central aperture 23 to receive a decorative element such as a flower pot 24 or an electric fountain, or may be used to admit light to the interior if this is desired. Positioned under aperture 23 may be a saucer 25 or other water retainer for cooperating with the flower pot, a candlestick for a candle taller than the height of top 12 above bottom 11, or other appropriate decorative element.

Bottom 11 is shown as configured to cooperate with a rotating arrangement such as a lazy susan 26 of the usual design. Alternatively, two or more of screws 14 may be replaced by screweyes or equivalent devices by means of which the body may be suspended from above on suitable cords or wires.

A second embodiment of the invention is shown in FIGS. 4–7. This arrangement 30 is designed for support on or against a vertical surface such as a wall: a pair of these devices may be supported on opposite sides of a thin panel such as a room divider to give the effect of passing through the panel.

This embodiment of the invention comprises a base 31, a top 32, and spacers 33, the top being held in place by screws 34. The spacers are provided with grooves 35, 36 and 37 receiving respectively a picture supporting member 40, a picture 41, and a picture protecting member 42. Since this structure is not for observation in the round, its rear surface may be closed by a suitable back 43, which is provided with a keyhole opening 44 for accepting the head of a support screw. Members 40–42 are shown in this embodiment of the invention to be arranged to present the picture as a convex cylindrical surface.

When it is desired to prepare my invention for use, screws 13 or 34 are loosened and top 12 or 32 is removed. The desired pictures are trimmed to appropriate size and shape and inserted between members 20 and 22 or members 40 and 42, and the top is replaced. Such additional decorative elements as are desired may be added, such as flower pot 24, after which the device is placed or suspended in its intended location.

From the foregoing it will be apparent that I have invented a new device for interior decorating comprising a three-dimensional frame for displaying a plurality of pictures alone or in ornamental association with other decorative elements such as plants, figurines, candles, and so forth. My invention may take a number of forms, two of which are specifically shown, and may present the pictures either flat or in non-planar surfaces: the pictures may be opaque or transparent. The arrangement may be rotatably supported from below or suspended from above or behind.

Numerous characteristics and advantages of my invention have been set forth in the foregoing description. Together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. A decorative picture frame comprising, in combination:

a generally flat base having a predetermined outline;

a plurality of elongated spacers having first ends secured to said base at intervals around the outline thereof;

a generally flat top having an outline similar to that of said base and a generally central aperture;

fastening means removably securing said top to second ends of said spacers to define with said spacers and said base a three-dimensional hollow body having a top opening, for receiving an ornamental object, and a plurality of peripheral openings, for receiving pictures to be displayed, each said peripheral opening being defined by a portion of said base, a portion of said top, and apposed edges of a pair of said spacers;

sets of inner and outer parallel, spaced grooves extending along apposed portions of pairs of said spacers between said base and said top, and oriented to lie in a set of predetermined geometrical surfaces;

picture supporting means in said inner grooves;

and picture protecting means in said outer grooves, so that a picture to be displayed may be inserted between said supporting means and said protecting means.

2. The structure of claim 1 in which said surfaces are planes.

3. The structure of claim 1 in which said fasteners include hanging loops.

4. The structure of claim 1 in which said picture supporting means are transparent.

5. The structure of claim 1 in which said picture supporting means are transparent and are secured in said inner grooves.

6. The structure of claim 1 together with a further picture receiving groove in each set between said inner and outer grooves.

7. The structure of claim 1 together with means for securing said frame to a vertical surface with said base substantially horizontal.

8. The structure of claim 1 together with means supporting said frame for rotation as a whole about a vertical axis passing through said base and said top, so that when pictures are placed in said peripheral openings and a decorative object is placed in said central opening, said rotation presents to an observer a sequence of pictures accompanied by a sequence of different views of said decorative object.

* * * * *